US007859469B1

(12) United States Patent
Rosener et al.

(10) Patent No.: US 7,859,469 B1
(45) Date of Patent: Dec. 28, 2010

(54) COMBINED BATTERY HOLDER AND ANTENNA APPARATUS

(75) Inventors: Douglas K. Rosener, Santa Cruz, CA (US); Joseph P. Watson, San Jose, CA (US); Thomas R. Trumbull, Los Gatos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 40 days.

(21) Appl. No.: 11/891,503

(22) Filed: Aug. 10, 2007

(51) Int. Cl.
*H01Q 1/24* (2006.01)

(52) U.S. Cl. ..... 343/702

(58) Field of Classification Search ..... 343/702
See application file for complete search history.

(56) References Cited

U.S. PATENT DOCUMENTS 5,963,177 A * 10/1999 Tuttle et al. ..... 343/872
6,067,056 A * 5/2000 Lake ..... 343/873
6,424,301 B1 7/2002 Johnson et al.

* cited by examiner

*Primary Examiner*—Rexford N Barnie
*Assistant Examiner*—Thienvu V Tran
(74) *Attorney, Agent, or Firm*—David S. Park; Haynes Boone LLP

(57) ABSTRACT

A combined, compact battery holder and antenna apparatus. The combined, compact battery holder and antenna apparatus includes a dielectric battery holder and a conductive antenna element having a radiating arm that is supported by the dielectric battery holder. When mounted on a printed circuit board (PCB), the dielectric battery holder maintains the radiating arm of the conductive antenna element at a constant height above a ground plane on the PCB. The compact, combined battery holder and antenna apparatus may be beneficially adapted and configured for use in a variety of electronic devices including, for example, wireless headsets or headphones, cellular communications devices, personal digital assistants (PDAs), and may be adapted and configured to operate according to various types of wireless technologies such as Bluetooth, Wi-Fi and cellular wireless technologies.

36 Claims, 6 Drawing Sheets

COMBINED BATTERY HOLDER AND ANTENNA APPARATUS

FIELD OF THE INVENTION

The present invention relates in general to wireless devices. More specifically, the present invention relates to a combined and compact battery holder and antenna support structure for wireless devices.

BACKGROUND OF THE INVENTION

The demand for more power efficient and lightweight wireless devices, such as cellular telephones, wireless headsets, and other wireless devices, has required engineers to devise new ways of reducing the size, compactness and integration of the devices' components. Significant strides have been made in reducing the size and compactness of circuit components (e.g., resistors, capacitors, transistors) using integrated circuit technology. However, not all components can be easily formed into an integrated circuit. For example, the antenna and battery, both of which are essential components of any mobile wireless device, are not typically formed as part of an integrated circuit. The power needed to power a wireless device's components is simply too large to allow the battery to be formed at a size that could be practically formed in an integrated circuit.

Antennas are also not typically formed as part of an integrated circuit. An antenna's dimensions and proximity to other conductors affects radiation patterns and efficiency, and the larger the antenna is the better. Furthermore, the high-frequency energy that is generated by the antenna can interfere with other electronics. For these reasons an antenna is usually kept as far away as possible from any integrated circuits, and the antenna is not, therefore, typically formed as part of an integrated circuit.

Because the battery and antenna cannot be easily formed in an integrated circuit, they are typically mounted on a printed circuit board (PCB), along with other electrical components of the wireless device. One type of antenna that is commonly used in such applications is the inverted "F" antenna (IFA). FIGS. 1A-C are top, side, and front views of a typical prior art IFA 100, respectively. As shown in the drawings, the IFA 100 comprises an inverted and horizontally disposed F-shaped electrically conductive structure 102, which is configured over a ground plane 104 formed on a PCB. The F-shaped structure 102 includes an inverted-L element having a vertical ground leg 106 and a long horizontal arm 108, and a vertical radio frequency (RF) feed leg 110. The horizontal arm 108 has a length L. It is configured so that it is at a height h above the ground plane 104. A first end of the vertical ground leg 106 is coupled to a first end of the horizontal arm 108, and a second end of the vertical ground leg 106 is coupled to the ground plane 104. The RF feed leg 110 has a first end that is coupled to the horizontal arm 108, and a second end that is coupled to RF circuitry (not shown) on the PCB.

The length L of the horizontal arm 108 and the height h of the horizontal arm 108 above the ground plane 104 determine the bandwidth of the IFA 100. The resonant frequency of the IFA 100 depends on how well the height h of the horizontal arm 108 above the ground plane is controlled. If the height h is not consistently controlled along the entire length L of the arm 108, the resonant frequency of the IFA 100 is shifted from, or tends to drift from, its desired value. A height h that is not well controlled also adversely affects the impedance matching of the antenna to the PCB and, consequently, results in degraded reception and/or transmission capabilities.

Accordingly, it is important that the height h of the horizontal arm 108 of the IFA 100 be well controlled over its entire length L.

In addition to controlling the height h of the horizontal arm 108 of an IFA 100, prior art approaches have focused on isolating the antenna, as best as possible, from conductive objects on the PCB. Conductive objects on the PCB, particularly those which extend substantially above the PCB surface can have the deleterious effect of detuning and/or degrading the radiation pattern of the IFA 100. The battery that is used to power the wireless device is also typically mounted on the same PCB as is the antenna. Since the battery is typically housed in a conductive case, prior art approaches strive to maintain ample separation between the battery and the antenna.

An unfortunate consequence of separating the antenna from the battery is that it prevents the design from being scaled down to a more compact size. In some applications, some degree of compacting can be achieved by "meandering" the length L of the horizontal arm 108 of the IFA 100, or by using a "planar" arm IFA (i.e., PIFA) that has the same or similar effect as an elongated linear arm. However, these approaches are not available if there is no space available on the PCB to accommodate the meandering or planar arm. Even in applications where space is available, the degree to which the design can be compacted is limited by the perceived need to maintain a generous degree of separation between the antenna and battery.

It would be desirable, therefore, to have methods and apparatus which allow an antenna, battery and/or other components of a wireless device to be combined in a manner that allows an overall reduction in size of the wireless device.

SUMMARY OF THE INVENTION

A combined, compact battery holder and antenna apparatus is disclosed. An exemplary combined, compact battery holder and antenna apparatus includes a dielectric battery holder and a conductive antenna element that is supported by the dielectric battery holder. When mounted on a printed circuit board (PCB), the dielectric battery holder maintains a radiating arm of the conductive antenna element at a constant height above a ground plane on the PCB.

According to one aspect of the invention, the dielectric battery holder has a cylindrically shaped bore, which is adapted to hold a coin-shaped type battery. The radiating arm of the conductive antenna element is formed at least partially around an outer surface of the coin-shaped type battery, and in a manner that maintains a constant spacing between the radiating arm and the outer circumference of the battery.

The systems and apparatus of the present invention offer a number of benefits and advantages over prior art approaches. For example, forming the radiating arm of the antenna element around the battery, and using the dielectric structure of the apparatus to both hold the battery and to support the antenna element allow a more compact design to be realized. Combining the battery holder and antenna support functions into a single component also reduces the number of parts needed in the assembly and, therefore, reduces overall costs of production.

The compact, combined battery holder and antenna apparatuses of the present invention may be beneficially adapted and configured for use in a variety of electronic devices including, for example, wireless headsets and headphones, wireless earbuds, hearing aid devices, cellular communications devices, personal digital assistants (PDAs), hand-held and lap-top computers configured with wireless network interface cards (NICs) or wireless modems, and satellite communications devices such as global positioning systems (GPSs). When adapted for use in such devices, the combined battery holder and antenna apparatuses may be further configured to operate according to any one of various types of wireless technologies or wireless technology standards such as, for example, Bluetooth, Wi-Fi (i.e., 802.11); WiMAX (802.16), and cellular technologies.

Other features and advantages of the present invention will be understood upon reading and understanding the detailed description of the preferred exemplary embodiments, found herein below, in conjunction with reference to the drawings, a brief description of which are provided below.

DETAILED DESCRIPTION OF THE INVENTION

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

Referring to FIGS. 2A-D, there are shown top, side, front and perspective views, respectively, of a combined battery holder and antenna apparatus 200 for a wireless device, according to an embodiment of the present invention. The combined battery holder and antenna apparatus 200 comprises an inverted and horizontally disposed F-shaped electrically conductive structure 202, and a dielectric combined antenna support and battery holder structure 204, both of which are configured over a horizontal ground plane 206. Although not shown, according to one embodiment the horizontal ground plane 206 is formed on a printed circuit board (PCB).

Figure 1A:
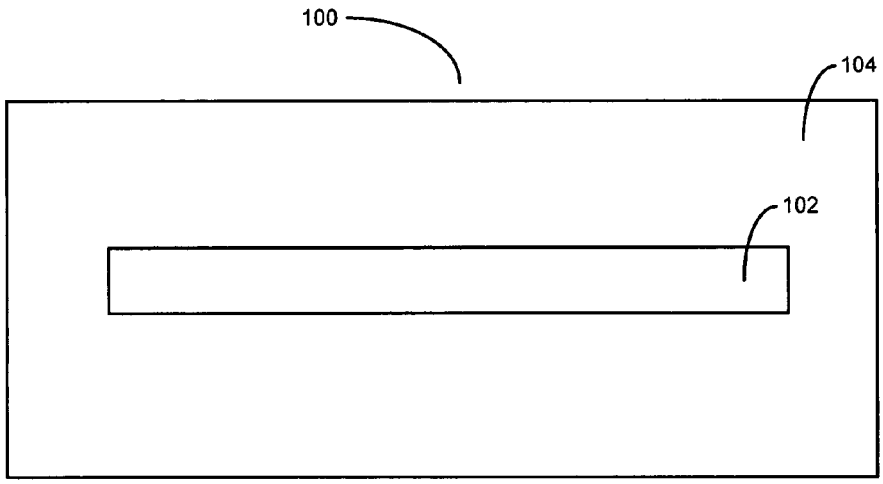
FIGURE 1A (Prior Art)
FIGS. 1A-C are top, side and front view drawings of an inverted "F" antenna (IFA), as is known in the prior art.
Figure 1B:
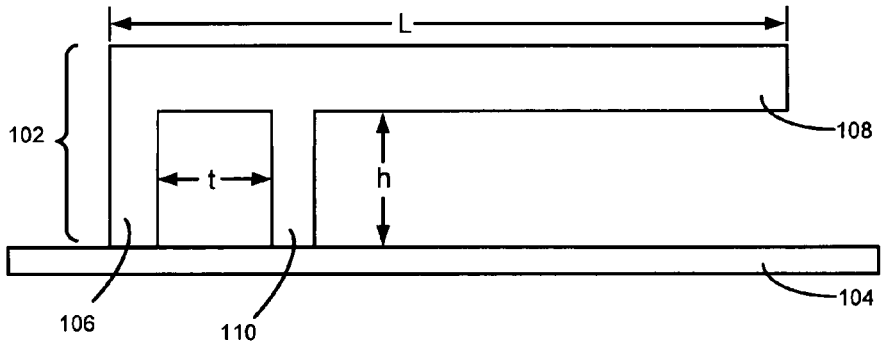
FIGURE 1B (Prior Art)
Figure 1C:
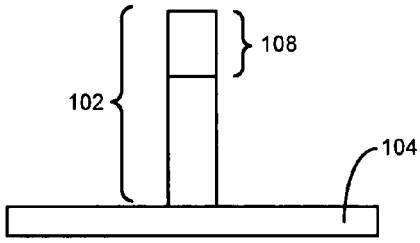
FIGURE 1C (Prior Art)
Figure 2A:
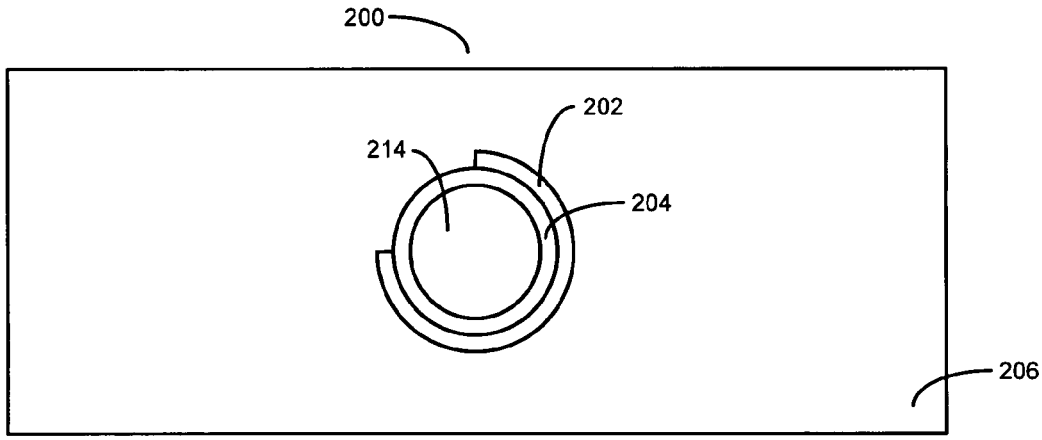
FIGS. 2A-D are top, side, front and perspective views of a combined battery holder and antenna apparatus, according to an embodiment of the present invention.
Figure 2B:
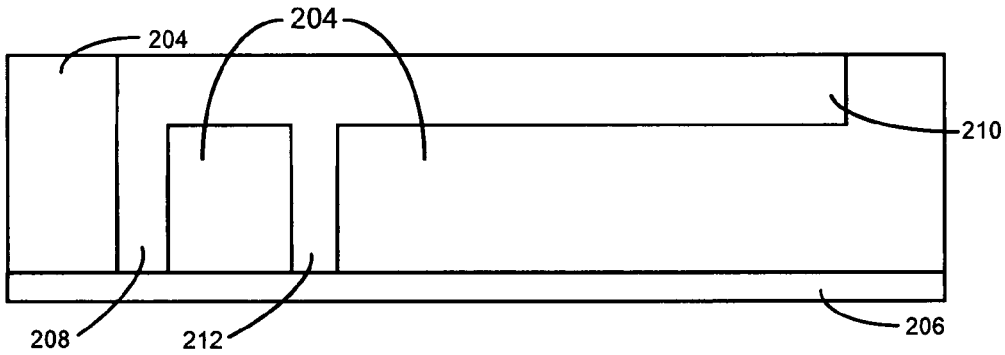
Figure 2C:
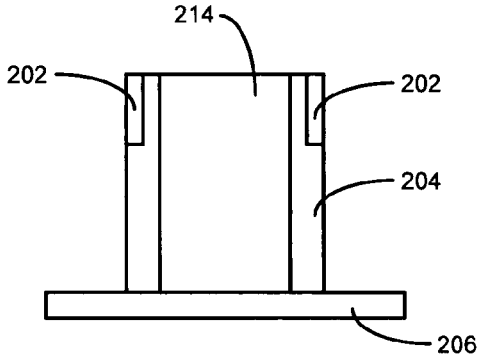
Figure 2D:
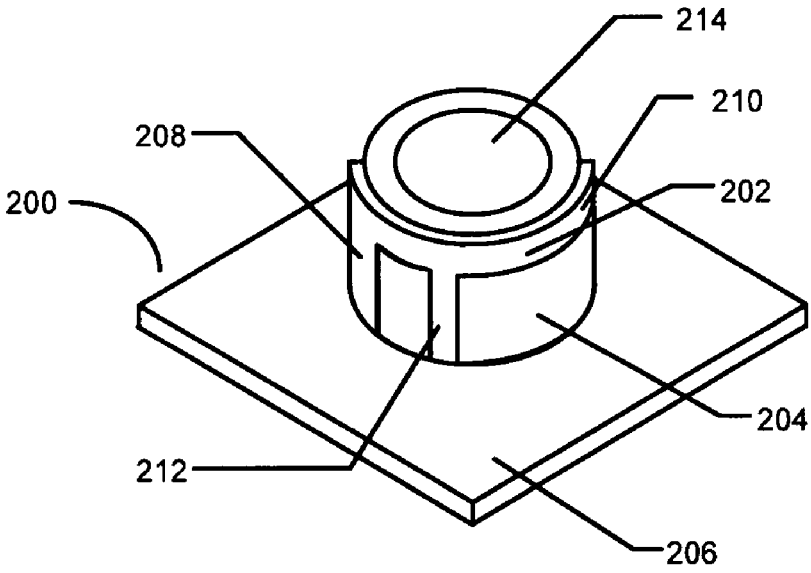

As best illustrated in the unwrapped side view of FIG. 2B, the horizontally disposed F-shaped electrically conductive structure 202 is circumferentially disposed around the outer circumference of the dielectric combined antenna support and battery holder structure 204. The conductor used to implement the F-shaped electrically conductive structure may have any cross-sectional shape. For example, it may have a circular cross-section, like a wire, thereby making the resulting IFA a wire inverted "F" antenna, or 'WIFA,' or may have a rectangular cross-section, thereby making the resulting IFA a planar inverted "F" antenna (PIFA).

As shown in FIGS. 2A-D, the F-shaped electrically conductive structure 202 comprises an inverted-L element having a vertical ground leg 208 and horizontal arm 210, and a vertical radio frequency (RF) feed leg 212. A first end of the vertical ground leg 208 is coupled to a first end of the horizontal arm 210, and a second end of the vertical ground leg 208 is coupled to the ground plane 206. The RF feed leg 212 has a first end that is coupled to the horizontal arm 210, and a second end that is coupled to RF circuitry of a wireless device (not shown). As can be seen in the drawings, the coupling of the RF feed leg 212 to the inverted-L element forms an inverted "F."

According to an embodiment of the invention, the dielectric combined antenna support and battery holder structure 204 is cylindrically-shaped with a hole formed through its center. The hole is adapted to receive a coin-type battery 214 having a conductive casing. When the coin-type battery 214 is disposed within the hole, the conductive casing acts as a vertical equipotential plane. While this and other exemplary embodiment of the invention described herein are shown and described as being adapted to receive a coin-shaped battery 214, those of ordinary skill in the art will readily appreciate and understand that the dielectric combined antenna support and battery holder structure 204 may be easily modified to accommodate batteries of other shapes, e.g., square, rectangular, etc.

Collectively, the F-shaped electrically conductive structure 202, dielectric combined antenna support and battery holder structure 204, horizontal ground plane 206 and conductive casing of the coin battery 214 form an inverted-F antenna (IFA). The dielectric support/holder structure 204 functions to hold the coin battery, provide a support for at least a portion of the length L of the horizontal arm, and separate the horizontal arm 210 at a controlled distance from the outer circumference of the coin battery 214. When the coin battery 214 is secured in the dielectric support/holder structure 204, the conductive casing of the coin battery 214 is in electrical contact with the horizontal ground plane 206, and acts as a vertical ground plane with respect to the F-shaped electrically conductive structure 202. As will be readily appreciated by those of ordinary skill in the art the terms "horizontal" and "vertical" are used for convenience of expression only. Although the horizontal and vertical ground planes are perpendicular to each other, they do not have to be oriented with respect to the horizon. Moreover, although the "horizontal" and "vertical" ground planes are described in this exemplary embodiment as being perpendicular, in alternative embodiments the ground planes need not be perpendicular.

Combining the antenna elements, antenna support structure, battery and battery holder into a single compact unit provides a number of benefits over prior art approaches. First, since the antenna support structure and battery holder are integrated into single structure 204, and the F-shaped IFA structure is forced to follow the contours of the support/holder 204, the combined battery holder and antenna apparatus 200 occupies significantly less PCB area than do prior art approaches. Second, the controlled spacing between the F-shaped electrically conductive structure 202 and the horizontal ground plane 206 helps to maintain the resonant frequency of the antenna at a stable and constant value. Third, combining the antenna elements, antenna support structure, battery and battery holder into a single compact unit allows a smaller PCB to be used, compared to the size of the PCB used to implement prior art approaches. Finally, the vertical ground plane provided by the conductive battery housing and the F-shaped electrically conductive structure 202 work together to direct RF radiation around the circumference of the battery 414, rather than being blocked by the presence of the battery.

Figure 3A:
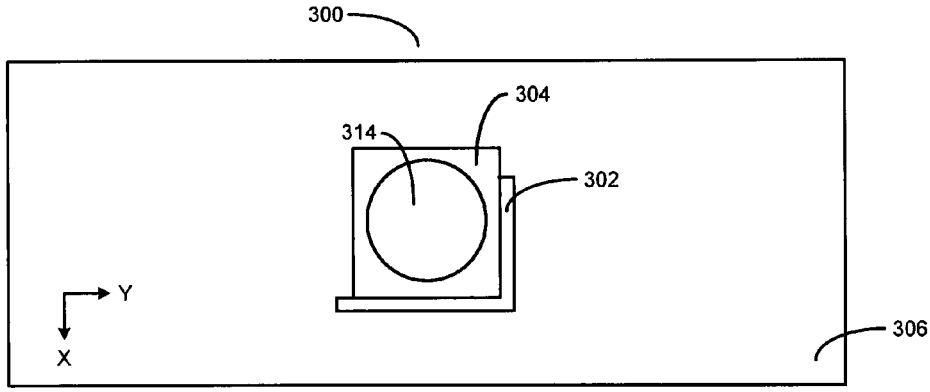
FIGS. 3A-C are top, side and rear views of a combined battery holder and antenna apparatus for a wireless device, according to an embodiment of the present invention.
Figure 3B:
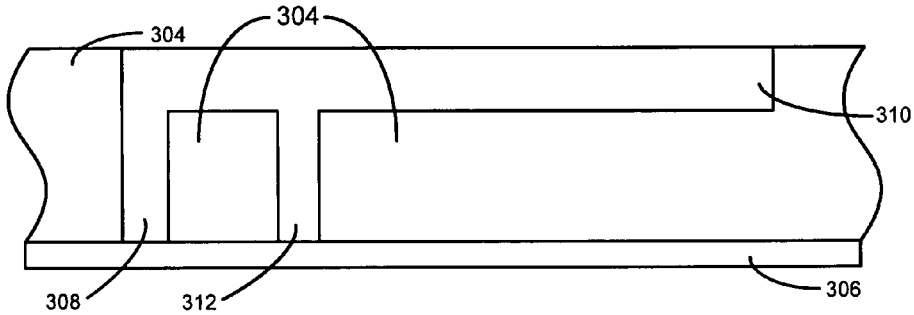
Figure 3C:
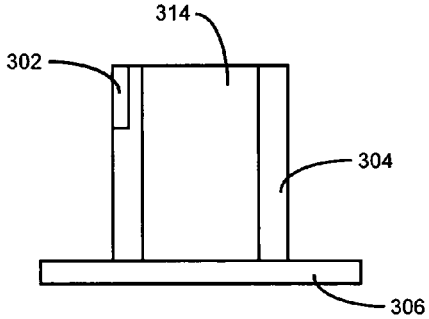

While the combined battery holder and antenna apparatus 200 in FIGS. 2A-D has been described as employing a dielectric combined antenna support and battery holder structure 204 having a circular cross-section, the outer periphery of the dielectric support/holder structure 204 may be formed according to any shape (e.g., polygonal or oval shaped cross-section). FIGS. 3A-C show for example, top, unwrapped side and rear views, respectively, of a combined battery holder and antenna apparatus 300 for a wireless device in which the dielectric combined antenna support and battery holder structure 304 has a cross-section in the form of a square. The rear view shown in FIG. 3-C is along the X axis marked in FIG. 3-A. For clarity, the rear view omits vertical ground leg 308. According to this embodiment of the invention, the F-shaped electrically conductive structure 302 follows the sharp angle contours of the dielectric support/holder 304. Following sharp angle contours may result in an increase in antenna impedance due to the fact that the spacing between F-shaped electrically conductive structure 302 and the vertical ground plane presented by the conductive case of the coin battery is no longer constant. However, depending on the manufacturing process being employed, these losses may be an acceptable trade off between performance and ease in manufacturing.

Figure 4A:
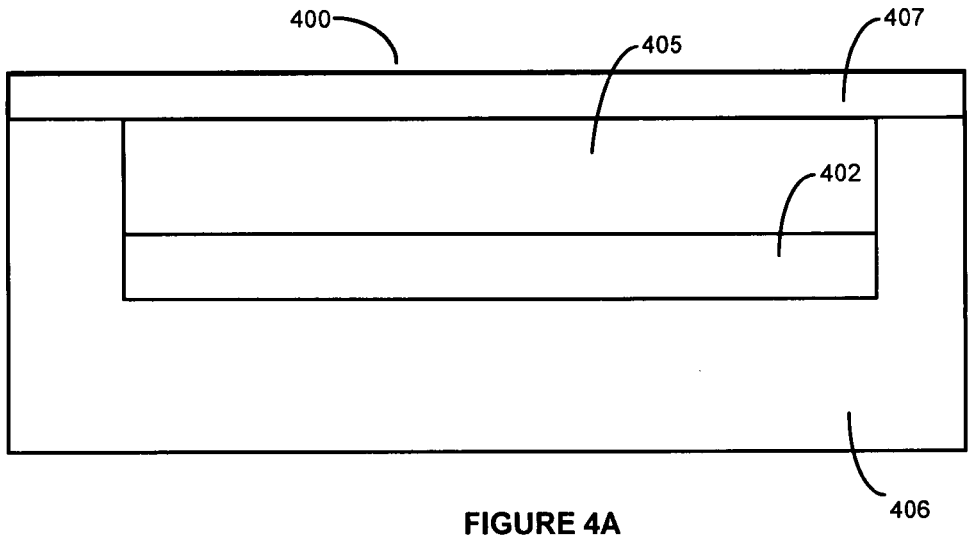
FIGS. 4A-C are top, side and front views of an inverted "F" antenna (IFA) structure having horizontal and vertical ground planes, according to an embodiment of the present invention.
Figure 4B:
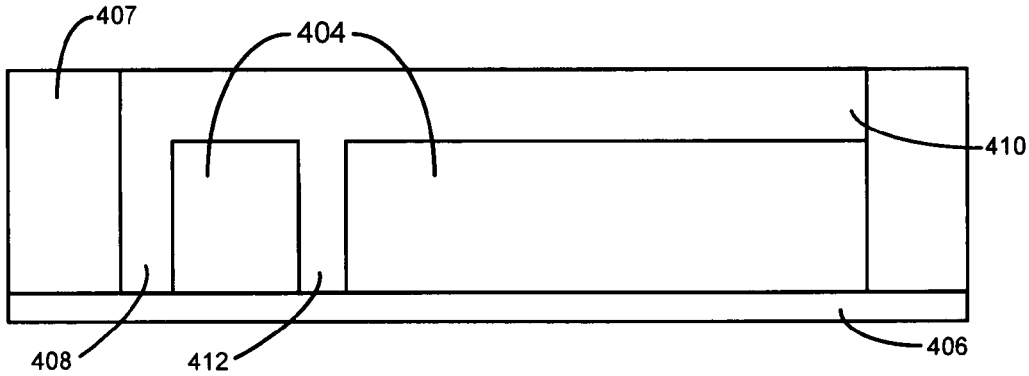
Figure 4C:
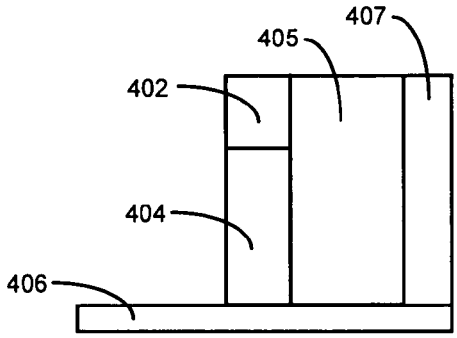

Although the vertical ground plane has been described as being provided by the conductive housing of a battery, the vertical ground plane can be formed by a variety of structures. FIGS. 4A-C illustrate, for example, top, side, and front views, respectively, of an IFA apparatus 400 having a vertical ground plane formed from any electrically conductive structure, according to an embodiment of the present invention. The IFA apparatus 400 comprises an inverted and horizontally disposed F-shaped electrically conductive structure 402, a dielectric antenna support structure 404, and a dielectric antenna spacer 405. Both the F-shaped electrically conductive structure 402 and the dielectric antenna support structure 404 are configured over a horizontal ground plane 406. The F-shaped electrically conductive structure 402 and the dielectric antenna spacer 405 are configured next to a vertical ground plane 407. Although not shown, according to other embodiments, either or both the horizontal ground plane 406 and the vertical ground plane 407 are formed on a printed circuit board (PCB).

As best illustrated in FIG. 4B, the horizontally disposed F-shaped electrically conductive structure 402 comprises an inverted-L element having a vertical ground leg 408 and horizontal arm 410, and a vertical radio frequency (RF) feed leg 412. A first end of the vertical ground leg 408 is coupled to a first end of the horizontal arm 410, and a second end of the vertical ground leg 408 is coupled to the ground plane 406. The RF feed leg 412 has a first end that is coupled to the horizontal arm 410, and a second end that is coupled to RF circuitry of a wireless device (not shown). The coupling of the RF feed leg 412 to the inverted-L element forms an inverted "F."

Although in FIG. 4A, the inverted and horizontally disposed F-shaped electrically conductive structure 402 is shown as being parallel to the dielectric antenna spacer 405 and to the vertical ground plane 407, the F-shaped electrically conductive structure 402, does not have to be parallel to the vertical ground plane 407. Further, as in other embodiments descried herein, the dielectric antenna spacer 405 may be formed according to any cross-sectional shape (e.g., polygonal, oval, square, etc.).

Figure 5:
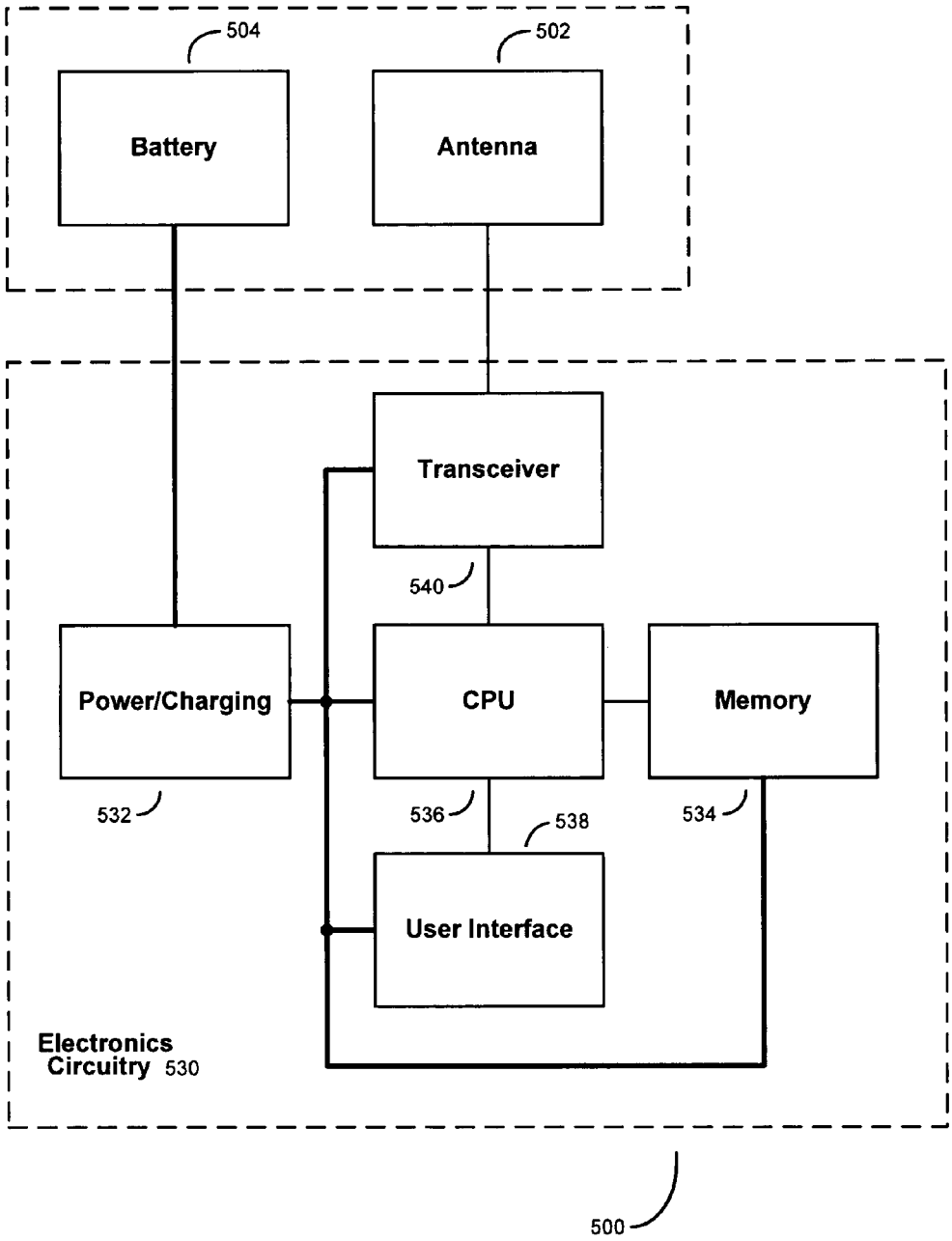
FIG. 5 is a block diagram illustrating how a wireless device may be adapted to employ either of the combined battery holder and antenna support apparatuses in FIG. 2 or 3, or the IFA structure in FIG. 4, in accordance with embodiments of the present invention.

FIG. 5 is a block diagram illustrating how a wireless device 500 may be adapted to employ any one of the combined battery holder and antenna apparatuses described above. The wireless device 500 comprises an antenna system 502, a battery 504, and electronic circuitry 530. The electronic circuitry 530 further includes a power/charging circuit 532, a memory 534, a CPU 536, a user interface 538, and a transceiver 540. The antenna system 502 represents one of the IFA assemblies previously described. The antenna system 502 is operable to transmit RF supplied from a transmitter portion of the transceiver 540, and direct RF energy received from a remote transmitter to a receiver portion of the transceiver 540. The battery 504 is configured to provide power to the wireless device 500 through the power/charging circuit 532. The battery 504 and antenna system 502 are configured according to one of the combined battery holder and antenna apparatuses described above. This configuration allows a wireless device to be more compactly designed, since the antenna 502 and battery 504 require less space than in prior art approaches, which strive to maintain a high degree of physical separation between the two components.

The wireless device 500 in FIG. 5 is depicted as a generic wireless device, to highlight the fact that the combined battery holder and antenna apparatuses of the present invention may be used in various types of wireless devices. For example, they may be adapted and configured for use in wireless headsets and headphones, wireless earbuds, hearing aid devices, cellular communications devices, personal digital assistants (PDAs), hand-held and laptop computers configured with wireless network interface cards (NICs) or wireless modems, and satellite communications devices such as global positioning systems (GPSs). When configured in such devices, the combined battery holder and antenna support apparatus may be further configured to operate according to any one of various types of wireless technologies or wireless technology standards such as, without limitation, Bluetooth, Wi-Fi (i.e., 802.11x (where 'x' stands for a, b, g or n)); WiMAX (802.16), cellular technologies such as the Global System for Mobile Communications (GSM), General Packet Radio Service (GPRS), Code Division Multiple Access (CDMA), Enhanced Data Rates for GSM Evolution (EDGE), Wide-Band CDMA (W-CDMA), and fourth generation (4G) wireless technologies.

Although the present invention has been described with reference to specific embodiments thereof, these embodiments are merely illustrative, and not restrictive, of the present invention. Various other modifications or changes to the specifically disclosed exemplary embodiments will be suggested to persons skilled in the art and are to be included within the spirit and purview of this application and scope of the appended claims.

What is claimed is:

1. A combined battery holder and antenna apparatus, comprising:

a dielectric battery holder; and a conductive antenna element supported above and apart from a ground plane by said dielectric battery holder, wherein said dielectric battery holder is disposed between the conductive antenna element and the ground plane, and further wherein said dielectric battery holder is disposed between the conductive antenna element and a battery mounted within the dielectric battery holder.

2. The combined battery holder and antenna apparatus of claim 1 wherein said antenna element comprises an F-shaped conductive structure.

3. The combined battery holder and antenna apparatus of claim 1 wherein said dielectric battery holder and said conductive antenna element are adapted so that a radiating arm of said antenna element is maintained at a constant distance above a ground plane of a printed circuit board (PCB), when the dielectric battery holder and conductive antenna element are mounted on the PCB.

4. The combined battery holder and antenna apparatus of claim 3 wherein said dielectric battery holder has a cylindrically shaped bore that is adapted to hold a battery.

5. The combined battery holder and antenna apparatus of claim 4 wherein said cylindrically shaped bore is adapted to hold a coin-shaped battery.

6. The combined battery holder and antenna apparatus of claim 5 wherein the dielectric battery holder is cylindrically shaped and has a circular cross-section that is concentrically aligned with a circular cross-section of the cylindrically shaped bore.

7. The combined battery holder and antenna apparatus of claim 6 wherein the radiating arm of said antenna element is formed at least partially around a circle concentrically aligned with an outer surface of the cylindrically shaped dielectric battery holder.

8. The combined battery holder and antenna apparatus of claim 7 wherein the radiating arm of said dielectric battery holder is formed so that there is a constant spacing between the radiating arm and an outer surface of the coin-shaped battery along a length of the radiating arm.

9. The combined battery holder and antenna apparatus of claim 8 wherein a circular sidewall of said coin-shaped battery operates as a quasi ground plane when the dielectric battery holder and conductive antenna element are mounted on a PCB.

10. The combined battery holder and antenna apparatus of claim 1 wherein the dielectric battery holder and the conductive antenna element are adapted for use in a Bluetooth-enabled wireless device.

11. The combined battery holder and antenna apparatus of claim 1 wherein the dielectric battery holder and the conductive antenna element are adapted for use in a wireless device configured to operate according to one or more of the 802.11x radio standards.

12. The combined battery holder and antenna apparatus of claim 1 wherein the dielectric battery holder and conductive antenna element are adapted for use in a wireless headset or wireless headphone.

13. The combined battery holder and antenna apparatus of claim 12 wherein the wireless headset or wireless headphone comprises a wireless earbud.

14. The combined battery holder and antenna apparatus of claim 1 wherein the dielectric battery holder and conductive antenna element are adapted for use in a cellular communications device.

15. A combined battery holder and antenna support apparatus, comprising:

a dielectric battery holder having a cavity configured to hold a battery; and a conductive antenna element having a radiating arm, which is supported above and apart from a ground plane by said dielectric battery holder and which is formed at least partially around a boundary defining an opening of said cavity, wherein said dielectric battery holder is disposed between the conductive antenna element and the ground plane, and further wherein said dielectric battery holder is disposed between the conductive antenna element and the battery mounted within the dielectric battery holder.

16. The combined battery holder and antenna support apparatus of claim 15 wherein the radiating arm is formed so that it maintains a constant spacing from the boundary defining the opening of said cavity.

17. The combined battery holder and antenna support apparatus of claim 15 wherein the cavity is cylindrically shaped and the boundary defining the opening of said cavity is circular shaped.

18. The combined battery holder and antenna support apparatus of claim 17 wherein the cavity is adapted to hold a coin-shaped battery and the radiating arm is formed so that it maintains a constant spacing from an outer sidewall of the coin-shaped battery.

19. The combined battery holder and antenna support apparatus of claim 15 wherein said dielectric battery holder and said conductive antenna element are adapted so that the radiating arm is maintained at a controlled distance above a ground plane of a printed circuit board (PCB), when the dielectric battery holder and conductive antenna element are mounted on the PCB.

20. The combined battery holder and antenna support apparatus of claim 15 wherein the dielectric battery holder and the conductive antenna element are adapted for use in a Bluetooth-enabled wireless device.

21. The combined battery holder and antenna support apparatus of claim 15 wherein the dielectric battery holder and the conductive antenna element are adapted for use in a wireless device configured to operate according to one or more of the 802.11x radio standards.

22. The combined battery holder and antenna support apparatus of claim 15 wherein the dielectric battery holder and conductive antenna element are adapted for use in a wireless headset or wireless headphone.

23. The combined battery holder and antenna support apparatus of claim 22 wherein the wireless headset or wireless headphone comprises a wireless earbud.

24. The combined battery holder and antenna support apparatus of claim 15 wherein the dielectric battery holder and conductive antenna element are adapted for use in a cellular communications device.

25. A wireless device, comprising:

electronic circuitry configured to be powered by a battery; and a combined battery holder and antenna support apparatus including a dielectric battery holder configured to hold a battery and a conductive antenna element electrically coupled to said electronic circuitry, said conductive antenna element having a radiating arm that is supported above and apart from a ground plane by said dielectric battery holder, wherein said dielectric battery holder is disposed between the conductive antenna element and the ground plane, and further wherein said dielectric battery holder is disposed between the conductive antenna element and the battery mounted within the dielectric battery holder.

26. The wireless device of claim 25 wherein the radiating arm of the antenna element is formed at least partially around an outer surface of a battery when the battery holder is holding a battery.

27. The wireless device of claim 26 wherein the battery holder is configured to receive and hold a coin-shaped type battery and the radiating arm is formed so that it is constantly spaced around the outer surface of the coin-shaped type battery when the coin-shaped type battery is being held by the battery holder.

28. The wireless device of claim 25 wherein the combined battery holder and antenna support apparatus is mounted on a printed circuit board (PCB) and the dielectric battery holder is configured to maintain the radiating arm of the conductive antenna element at a constant distance above a ground plane of the PCB.

29. The wireless device of claim 28 wherein a circular sidewall of said coin-shaped battery operates as a quasi ground plane when the combined battery holder and antenna support apparatus is mounted on the PCB.

30. An apparatus, comprising:

a wireless device having electronic circuitry configured to be powered by a battery;

an antenna electrically coupled to the electronic circuitry of said wireless device; and a dielectric battery holder and antenna support structure configured to both hold a battery and to support a conductive antenna element of said antenna above and apart from a ground plane of a printed circuit board, wherein the dielectric battery holder and antenna support structure is provided between the conductive antenna element and the ground plane, and further wherein the dielectric battery holder and antenna support structure is disposed between the conductive antenna element and the battery mounted within the dielectric battery holder and antenna support structure.

31. The apparatus of claim 30 wherein the wireless device comprises a headset.

32. The apparatus of claim 30 wherein the wireless device comprises a headphone.

33. The apparatus of claim 30 wherein the wireless device comprises an earbud.

34. The apparatus of claim 30 wherein the wireless device comprises a Bluetooth-enabled wireless device.

35. The apparatus of claim 30 wherein the wireless device comprises a wireless device configured to operate in accordance with one or more of the 802.11x radio standards.

36. The apparatus of claim 30 wherein the wireless device comprises a cellular communications device.

* * * * *